United States Patent [19]

Zangrando

[11] Patent Number: 4,601,183

[45] Date of Patent: Jul. 22, 1986

[54] PNEUMATIC KEY LOCK

[75] Inventor: Roy A. Zangrando, Boonton, N.J.

[73] Assignee: The United States of America as represented by the Secretary of the Army, Washington, D.C.

[21] Appl. No.: 623,255

[22] Filed: Jun. 21, 1984

[51] Int. Cl.[4] ..... E05B 51/00

[52] U.S. Cl. ..... 70/275; 70/337; 70/405; 70/DIG. 48

[58] Field of Search ..... 70/DIG. 48, 265, 337, 70/339, DIG. 51, 385, 405, 275, 134, 263, 264, 352, 345, 348, DIG. 50

[56] References Cited

U.S. PATENT DOCUMENTS

| | | | |
|---|---|---|---|
| 2,888,287 | 5/1959 | Taylor | 70/263 |
| 3,154,938 | 11/1964 | Cohen | 70/265 |
| 3,524,334 | 8/1970 | Salvesen | 70/275 |
| 4,033,161 | 7/1977 | Goes | 70/DIG. 48 X |
| 4,090,175 | 5/1978 | Hart | 70/DIG. 51 X |
| 4,266,415 | 5/1981 | Clarke | 70/DIG. 48 X |
| 4,360,074 | 11/1982 | Parquet | 70/263 X |

FOREIGN PATENT DOCUMENTS

| | | | |
|---|---|---|---|
| 1553363 | 2/1970 | Fed. Rep. of Germany | 70/DIG. 51 |
| 1456138 | 11/1976 | United Kingdom | 70/263 |

*Primary Examiner*—Gary L. Smith
*Assistant Examiner*—Lloyd A. Gall
*Attorney, Agent, or Firm*—Robert P. Gibson; Anthony T. Lane; Michael C. Sachs

[57] ABSTRACT

A pneumatically-operated unlocking system suitable for use on the door of a high security building such as a military weapons storage structure, in which each one of a pair of unlocking keys is provided with a different combination of holes and no holes arranged in an n-position pattern to define an n-bit binary code. An encoder outside of the building pneumatically reads the said binary codes on the two unlocking keys in sequence and transmits the resulting pneumatic binary codes through conduits in the building walls to a logic device inside thereof where the binary codes are compared to two n-bit reference pneumatic binary codes derived from a pair of reference keys located inside of said building. If the codes on the two unlocking keys match those on the reference keys, a pneumatic output is produced which can be used to unbolt the door from the building.

2 Claims, 6 Drawing Figures

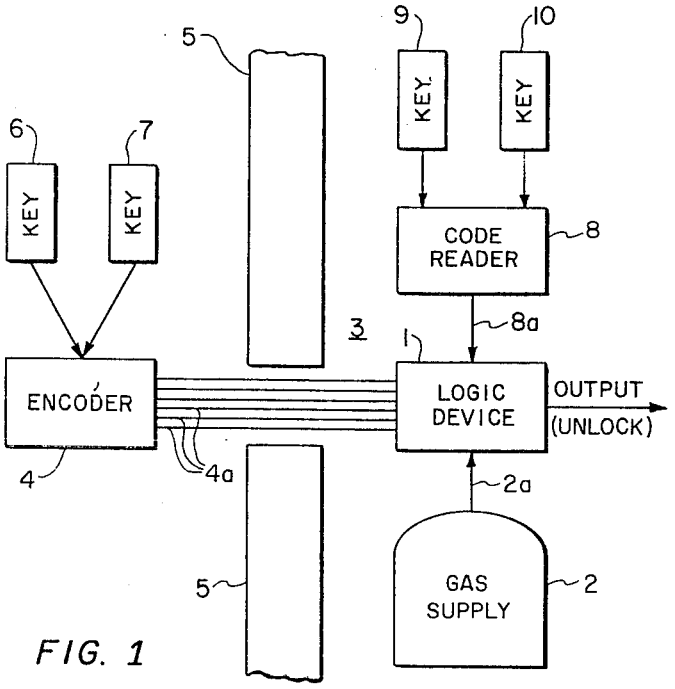
FIG. 1
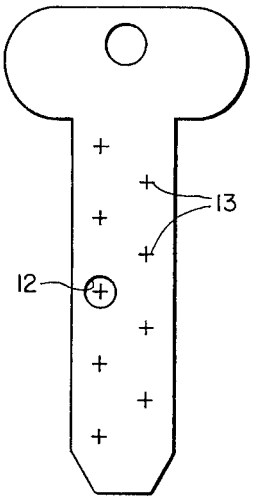
FIG. 2
FIG. 3
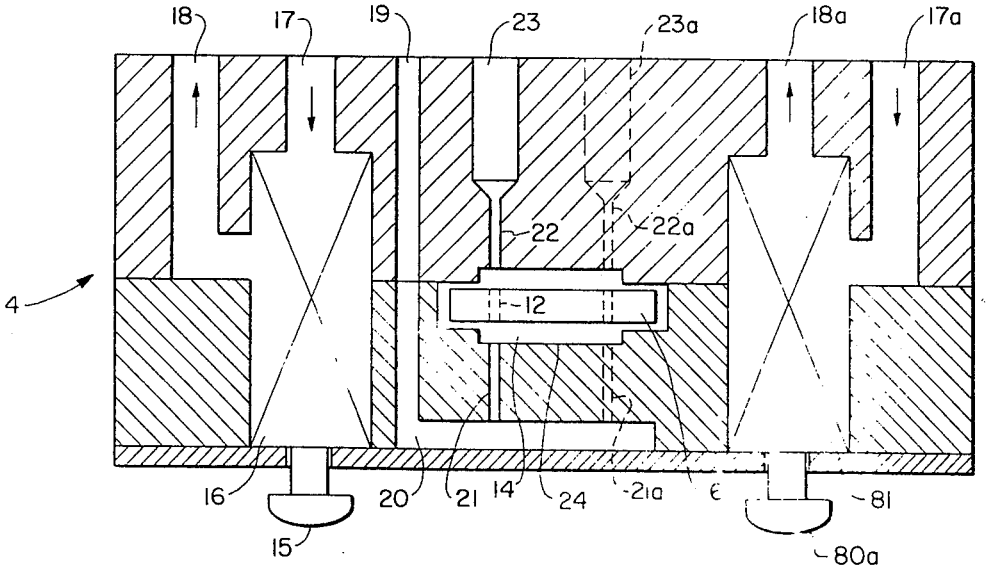

PNEUMATIC KEY LOCK

The invention described herein may be manufactured, used, and licensed by or for the Government for governmental purposes without the payment to me of any royalties thereon.

BACKGROUND OF THE INVENTION

Access to military weapon storage structures known as igloos is currently controlled by multiple, high security type padlocks. These devices are attached to hasps on the exterior of the building doors, and are thus susceptible to defeat by force. To enhance the security of these storage sites, means have been devised to remotely bolt the doors from the inside, and to provide other physical impediments to weapon access within the igloo. These devices require a means of activation from the exterior of the igloo which can be operated only by authorized personnel. A need therefore exists for a coded device accessible from outside the secured area or structure but resistant to forcible bypass, to control the aforementioned entry devices and other physical impediments.

Recessed mechanical devices are more difficult to protect since means must be provided to insert the key(s) directly into the mechanism, and further do not have the flexibility to transmit the output to remote locking devices such as deadbolts, without employing complex linkages. Electrical/electronic devices provide remote operation and flexibility but require batteries if electric power is unavailable and/or as a backup in the event of power failure. Batteries require frequent replacement or recharge which involves considerable expense. In addition, electrical devices require means to prevent explosive hazards when employed in ammunition storage areas. The pneumatically operated system of the present invention does not have these disadvantages.

SUMMARY OF THE INVENTION

The present invention relates to a pneumatic lock suitable for use on weapon storage structures and other highly secure areas, which upon the receipt of the proper input stimuli will provide an output which may be used to function or initiate various security devices. The lock is powered by compressed gas and is comprised of an encoding device outside the structure or secure area which reads in sequence the binary code pattern on each of two separate unlocking keys (two man control) and transmits said patterns through the structure wall via pneumatic hoses to a logic assembly or decoder protected within the structure. The logic device compares the key patterns transmitted from the outside with the patterns on another pair of reference keys which are inserted in a code reader also located within the structure. If the patterns match, gas pressure is applied to the output hose which in turn controls a physical access device or the door bolt.

The present invention provides a pneumatically-operated unlocking system suitable for use on the door of a high security building. As a feature of this invention, each one of a pair of unlocking keys is provided with a different combination of holes and no-holes arranged in an n-position pattern to define an n-bit binary code. The system of this invention comprises means located outside of said building to pneumatically read the said binary codes in sequence and to transmit pneumatically the resulting binary codes through conduits in the wall of said building to a logic device inside thereof where said two binary codes are compared in sequence to two n-bit reference pneumatic binary codes derived from a pair of reference keys located inside of said building. Means are provided to unbolt said door if both of said binary codes match the said two reference binary codes. Said locking system has the security features of having a total of $2^{2n}$ possible unlocking combinations or code sequences, it has two man control capability, and the unlocking code can be easily changed by changing one or both of said reference keys.

Thus it is an object of this invention to provide a secure key operated locking system control for weapon storage structures.

Another object of this invention is to minimize susceptability of forcible entry to high security structures or areas.

A still further object of the invention is to provide a locking system which requires two coded keys for the operation thereof thus providing for two-man control.

Another object of this invention is to provide a system of the type in which the two necessary reference keys for operation can be easily changed to alter the unlocking combination.

Another object of this invention is to employ a self-contained pneumatically operated combination lock which does not require electric power for its operation.

BRIEF DESCRIPTION OF THE DRAWINGS

FIG. 1 is a schematic block diagram of a lock according to the invention, depicting the major functional components and their interrelationships.

FIG. 2 is a side view of a key according to this invention showing code bit locations.

FIG. 3 is a top view in transverse section showing functional elements and gas flow patterns in a typical configuration of the encoder.

DETAILED DESCRIPTION OF THE INVENTION

Figure 4:
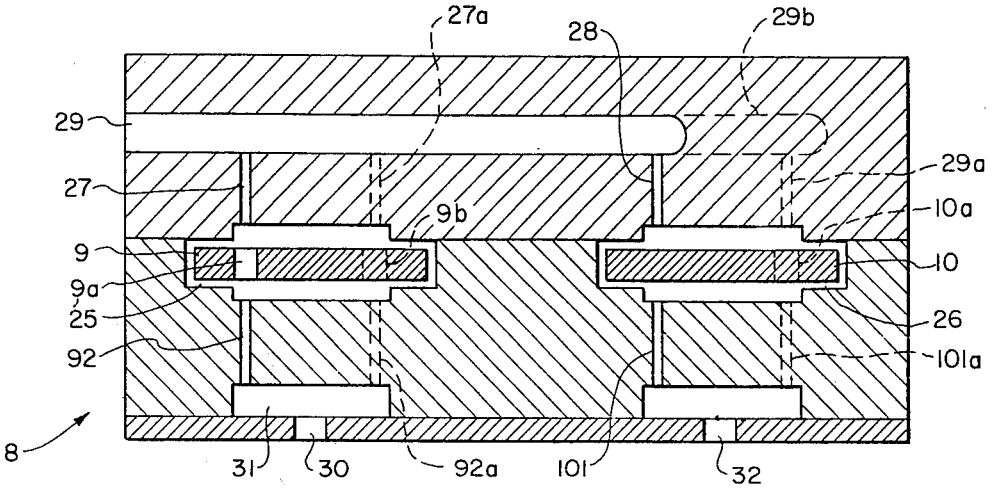
FIG. 4 is a top view in transverse section showing gas flow patterns in an illustrative configuration of a reference key reader.

Referring to the drawings, the invention as shown in FIG. 1 is comprised of a logic device 1, powered by a compressed gas supply 2, which may be nitrogen gas, for example, and which is located inside the secured area 3. An encoder 4 located outside the wall 5 of the secured area 3 converts the physical binary code pattern on each of two insertable and removable unlocking keys 6 and 7 into pneumatic form, in sequence, and transmits the code through the wall 5 via pneumatic tubes **4*a* to the logic device 1. The keys 6 and 7 are inserted in sequence into encoder 4. A code reader 8 similarly reads two reference keys 9 and 10 in sequence. The keys 9 and 10 are retained in the reader 8 and thus comprise the set or unlocking code. The logic device 1 compares key 6 with 9 and then 7 with 10 and if the corresponding pairs match, an output signal is supplied to operate a securing device, for example a pneumatically actuated bolt. The lock code may be changed by replacing either or both of reference keys 9 and 10 in the code reader 8**.

Referring now to FIG. 2, the key blank shown therein is coded by providing a hole 12 in one or more of a multiplicity of predetermined locations 13, each of which represents one bit of the code. The illustrative embodiment of the invention described herein utilizes a 9 bit binary code represented by the hole 12 and the 8 locations 13 with no holes, but the number of bits can be varied to suit the degree of security desired. The presence of holes or of no holes represent the binary bits "1" and "0" respectively. Referring to FIG. 3, coded key 6 is inserted into a key slot 14 in the encoder 4. Depressing read button 15 actuates valve 16, allowing the gas pressure from gas supply 2 at port 17 to flow out of port 18 to logic device 1. The logic device 1 in turn switches gas pressure to port 19 of the encoder 4 which supplies a gas jet manifold 20. Nine small holes, one of which is labelled 21 here, between the manifold 20 and the key slot 14 are arranged in a fixed pattern the same as that described above for the key of FIG. 2, and these holes allow air to flow from manifold 20 in the form of gas jets passing across the key slot 14. Directly opposite each of these holes are similar receiver holes, one of which is 22, each having its own output port, such as 23. Thus it can be seen that in the absence of any obstruction the gas jets provide gas pressure at each and every output port. The hole 21*a* and its mating receiver hole 22*a*, and its output port 23*a* are located at a different level of the encoder 4. If obstructed, as with a key with no hole therein, the gas jets are deflected and exhaust through relief slot 24. The gas does not then reach the corresponding receivers such as 22 and no output pressure is provided at the output port. The presence of a key in the slot 14 will therefore allow a gas jet to reach its receiver only when there is a corresponding hole 12 in the key through which the gas jet may pass. A binary pneumatic code is thus established with pressure at the output ports caused by a hole in the key denoting a "1" and no hole and no pressure denoting a "0". Each one of the output ports 23, 23*a*, etc. has a separate pneumatic tube in the tube bundle 4*a* for connecting the unlocking code to the apparatus within the secure area 3.

Referring to FIG. 4, the code reader 8 is comprised of two key slots 25 and 26 each of which function in a manner similar to those described for the encoder but differ in that corresponding receiver holes 27 and 28 share the same output port 29, since the codes on reference keys 9 and 10 in slots 25 and 26 are read in sequence. Gas pressure applied to input port 30 supplies the air jet manifold 31 and as described previously herein, establishes a binary pneumatic code at the output ports, one of which is 29, corresponding to the hole pattern on the reference key 9 in slot 25. Similarly, gas pressure subsequently applied to input port 32 will provide the code from the key 10 in slot 26 at the same set of output ports, one of which is 29. Gas pressure is never applied to both input ports 30 and 32 at the same time. The receiver ports 27*a* and 29*a* represent code bits at a different level and pressure or the lack of it therein is conveyed to output port 29*b*.

The holes 92, 92*a*, 101 and 101*a* connect the input ports 30 and 32 to the key slots 25 and 26.

Figure 5:
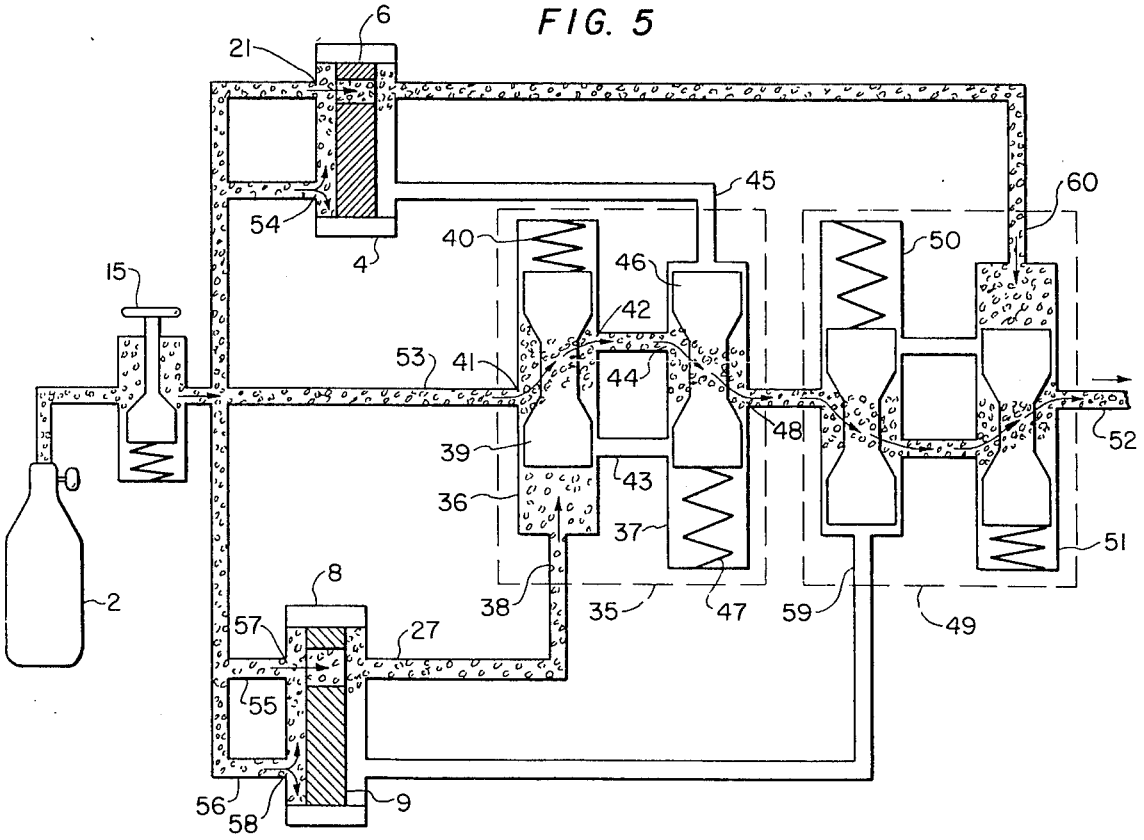
FIG. 5 is a diagram of a simplified single key, 2 bit version of the lock, according to the invention, which illustrates the principle of operation.

Referring now to FIG. 5, a simplified 2 bit, single key version of the logic device is shown to illustrate the principles of operation. A pair of 3 way spring biased valves 36 and 37 are connected in a manner which causes the first valve 36 to function as a selector and the second valve 37 to function as a diverter. Gas pressure applied to the pilot port 38 of the selector valve 36 moves the spool thereof 39 against spring bias 40 thus directing gas pressure at the supply port 53 to output port 42 and at the same time blocking output port 43. Pressure from output port 42 is directed to supply port 44 of valve 37, whereat, in the absence of pressure at pilot port 45, spool 46 is biased by spring 47 to direct the pressure at port 44 to output port 48. Conversely, for valve pair 49, the absence of pilot pressure to selector valve 50, combined with pilot pressure to diverter valve 51, permits gas pressure to be transmitted through valve pair 49 as shown by the arrows therein. Thus it can be seen that any valve pair requires pilot pressure at either one of, but not both of the valves constituting the pair. When all valve pairs in a lock are in said combination, gas may then flow through the series of valves to the output 52 where it may be used to effect the appropriate unlocking function. In operation, depressing read button 15 allows gas from supply tank 2 to flow to supply port 53 of the first valve pair 35 in the series, and also to gas jets 21 and 54 of the encoder 4, and gas jets 55 and 56 of the code reader 8. A reference key 9 in the code reader 8 with a hole therein permits gas jet 57 to impinge on receiver 27 thus applying pressure to pilot port 38 of valve 36 of valve pair 35. Similarly, the key 9 blocks gas jet 58 because of the lack of a hole therein, thus providing no pressure at pilot 59 of valve 50 in the next valve pair 49. Said key 9, having previously been inserted in the code reader 8, defines the code pattern required for the key 6 inserted by the operator into the encoder 4, to be the complement of the pattern on key 9. In the same manner as heretofore described, said key 6 provides gas pressure to the pilot 60 of valve 51 and no pressure to pilot 45 of valve 37. Thus the unlock condition is established, and gas flows at the output 52 until the read button 15 is released.

Figure 6:
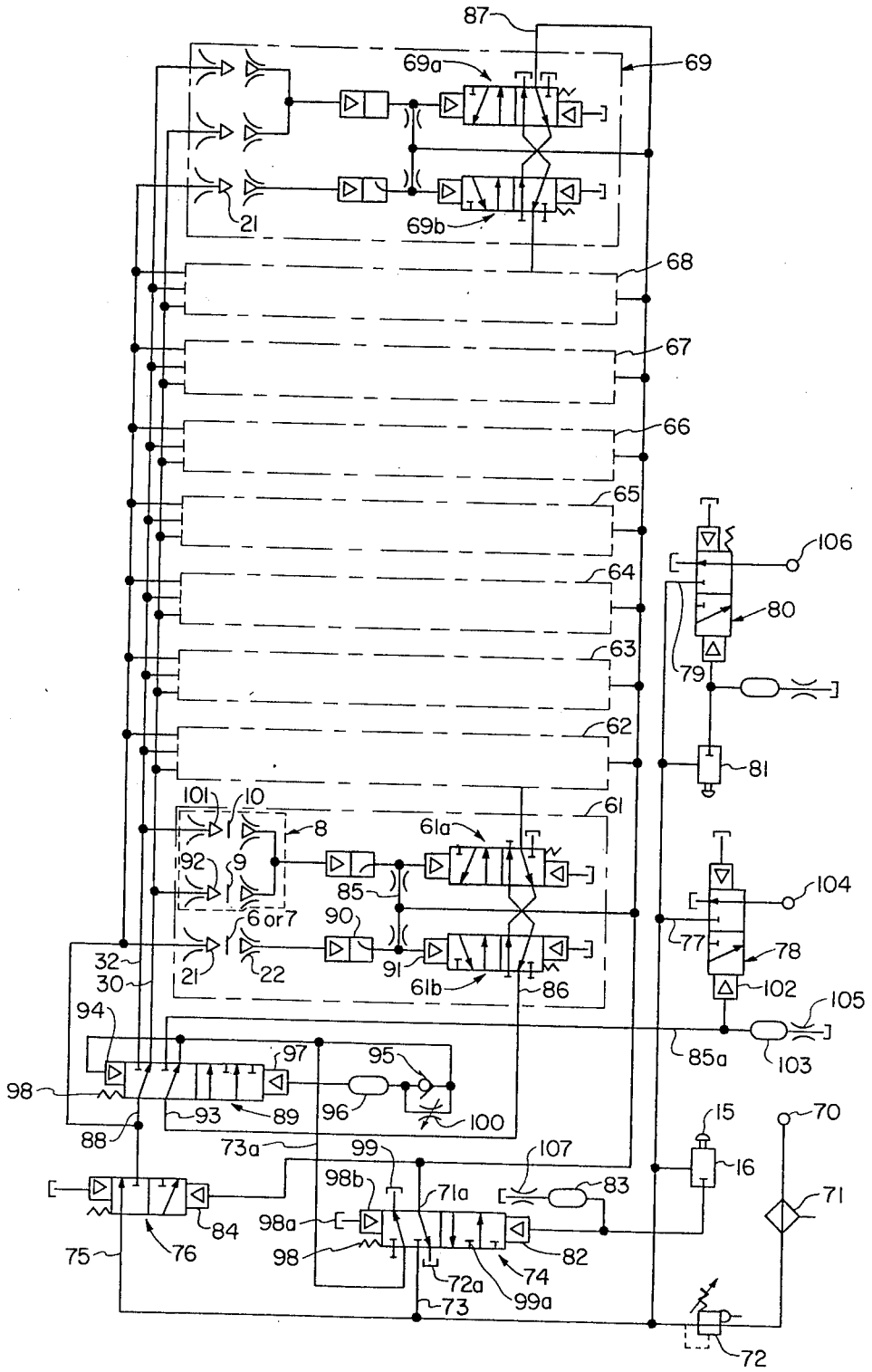
FIG. 6 is a schematic of the invention showing all functional elements for a system using two 9 bit binary codes.

Referring now to FIG. 6, the embodiment shown therein is comprised of nine valve pairs 61 through 69 establishing a 9 bit lock having 512 possible key patterns for each of the two keys for a total of 262,144 possible combinations. Read valve 74, taken as an example, comprises a spring 98 which holds the piston therein in the normal position to provide the illustrated pneumatic connections between the ports thereof. The symbol 82 represents the pilot of valve 74 to which gas pressure is applied to overcome the force of spring 98 and shift the valve to its operating position wherein all of the pneumatic connections therethrough will be shifted. As an example, when pilot 82 is energized by gas pressure, the line 73 which is shown applied to a dead end plug will be shifted to output port 71*a*, and pneumatic line 73*a* which normally is applied to vent 99 will be applied to dead end plug 99*a*. The valve 74 is shown equipped with a reverse pilot 98*b* which, when pressurized, aids the spring 98 in holding the piston in the normal or "off" position. This reverse pilot 98*b* is shown with a vent 98*a* connected thereto. The dual valve 89 also includes a reverse pilot 94.

The apparatus of FIG. 6 comprises nine pairs of valves 61–69, one for each binary digit to be compared. The valve pairs 69 and 61 are shown in detail with the intervening ones 62–68 having the same structure and shown only as blocks. In the valve pair 61, the valve 61*a* receives the decoded output of one of the nine bits of each one of the reference keys 9 and 10, in sequence, while the other valve of this pair 61*b*, simultaneously receives the decoded output of the same bit of one of the unlocking keys 6 or 7. If the decoded bits properly match, one of the valves of the pair will have pilot pressure and will thus be switched while the other will have no pilot pressure and thus will not be switched. When such a match occurs for all valve pairs 61–69, a continuous path will be set up through all 18 valves from input port 87 of valve 69*a* to output port 86 of valve 61*b*.

The operation of the apparatus of FIG. 6 is as follows: The gas supply 2 (not shown) connected to the power input port 70 supplies gas through filter 71 and regulator 72 to supply ports 73 of read valve 74, 75 of gas jet valve 76, 77 of unlock valve 78, 79 of lock valve 80, and to the read actuator 16 and lock actuator 81. Actuator 16 applies pressure to pilot 82 of valve 74 and accumulator or tank 83 whereupn said valve 74 shifts, applying gas pressure to pilot 84 of valve 76, via output port 71*a*, to pilot supply port 85 of valves 61*a* and 61*b*, as well as corresponding pilot supply ports of all remaining valves constituting valve pairs 61 through 69 and to the input port 87 of the first valve pair 69 in the series.

Valve 76 in turn shifts, applying pressure from the line 75 thereof to supply port 88 of valve 89, and to gas jet(s) 21 of encoder 4. If said gas jet is not blocked by key 6, the low pressure resulting from said gas jet impinging on receiver 22 actuates pneumatic amplifier 90 which allows the higher pilot supply pressure at port 85 of valve 61*b* to build up at pilot 91 and switch said valve 61*b*.

Gas pressure at supply port 88 of valve 89 is directed by said valve 89 to input 30 and gas jet(s) 92 of code reader 8. As described above, key 9 in code reader 8 is compared with key 6 in encoder 4, and if correct, gas passage is cleared through valve pair 61 and also through all subsequent valve pairs 62 through 69, and gas pressure is applied to second supply port 93 of valve 89. Said pressure is directed by valve 89 to reverse pilot 94 of the same valve 89 and through check valve 95 to accumulator or tank 96 which supplies forward pilot 97 of valve 89. Pressure is thus applied to both pilots 94 and 97 of valve 89 but said valve does not shift because of the added bias of spring 98 acting in conjunction with pilot 94.

Gas pressure in accumulator 83 now bleeds down through restrictor 107 to a point where spring 98 overcomes the remaining pressure in pilot 82 and valve 74 resets, shutting off gas supply to all other valves as previously described, and all such valves in turn reset. Pressure at reverse pilot 94 of valve 89 then bleeds down via vent 99 of valve 74, thus allowing pressure in accumulator 96 and pilot 97 to shift valve 89. Said valve 89 will remain in the shifted position until the pressure in accumulator 96 bleeds down through restrictor 100 and vent 99. That period of time as determined by restrictor 100 constitutes the time period within which the second key 7 must be inserted into encoder 4 to unlock the device.

Said key 7 having been inserted, the actuation of valve 16 initiates the same sequence of events as heretofore described for the first key 6, except as follows: Valve 89, now shifted, diverts gas flow to the other input 32 of the code reader 8 and gas jet(s) 101 and thus compares key 7 in the encoder 4 with key 10 in the code reader. Upon successful comparison, pressure at the second supply port 93 of valve 89 from output port 86 of valve 61*b* is directed to pilot 102 of valve 78 and accumulator 103 via pneumatic line 85*a*. Valve 78 shifts, directing pressure at supply port 77 to output port 104 where it can perform the desired enabling function, for example, actuating a pneumatic piston which unbolts a door. The output pressure remains present until the pressure in accumulator 103 bleeds down through restrictor 105 and the valve 78 resets. The relocking function is accomplished by lock valve 80 which when initiated by valve 81 on the encoder 4 functions in the same manner as unlock valve 78 and provides pressure at port 106, which pressure can be used to rebolt the door by actuating the same pneumatic piston.

While the invention has been described in connection with an illustrative embodiment or embodiments, the invention includes all obvious variations thereof which will occur to those skilled in this art; accordingly the invention should be interpreted to include the full scope of the invention, specification, and claims.

What is claimed is:

1. A highly secure structure for a secure area such as a weapons store, including an access security lock employing compressed nitrogen gas for controlling the bolt of a door to said secure structure, comprising: inside apparatus within said structure and remote from the vicinity of said door comprising a supply of compressed nitrogen gas, a logic device, a code reader with two reference keys therein; and, outside apparatus, outside of said structure and remote from said inside apparatus comprising an encoder receiving two removable unlocking keys in sequence, with a plurality of compressed gas pneumatic lines connecting the aforementioned inside and outside apparatus of said structure, all of said keys being coded by means of a pattern of holes and no-holes therein at fixed locations thereon to define a binary code, said encoder adapted to pneumatically read by means only of compressed gas passing through holes in said card or being blocked by said no-holes, the said binary codes on said two unlocking keys in sequence and converting the patterns thereon to pneumatic binary codes which are transmitted to said logic device via said pneumatic lines, said code reader being adapted to pneumatically read the said binary code patterns on said two reference keys in sequence and to transmit the pneumatic binary codes so as to read said logic device where they are sequentially compared to the codes received from said two unlocking keys, and means to produce a pneumatic output used for unbolting said door if the two said unlocking key codes match the two said reference key codes.

2. The structure of claim 1 wherein the number of bits in said binary code is nine.

* * * * *